US007988023B1

(12) United States Patent
Nykoluk

(10) Patent No.: US 7,988,023 B1
(45) Date of Patent: Aug. 2, 2011

(54) ADJUSTABLE GUN SLING

(75) Inventor: Cory Nykoluk, Oakdale, CA (US)

(73) Assignee: 5.11 Inc., Modesto, CA (US)

( * ) Notice: Subject to any disclaimer, the term of this patent is extended or adjusted under 35 U.S.C. 154(b) by 1189 days.

(21) Appl. No.: 11/652,378

(22) Filed: Jan. 10, 2007

(51) Int. Cl.
*F41C 33/00* (2006.01)

(52) U.S. Cl. ..... 224/150; 224/258; 224/578; 224/913

(58) Field of Classification Search ..... 224/150, 224/578, 579, 604, 258, 913, 257, 600, 259, 224/580, 184, 606, 607; 42/85
See application file for complete search history.

(56) References Cited

U.S. PATENT DOCUMENTS

| | | | | | |
|---|---|---|---|---|---|
| 4,249,686 | A * | 2/1981 | Morwood | 224/150 |
| 4,511,070 | A * | 4/1985 | Hightower | 224/150 |
| 4,815,640 | A * | 3/1989 | Johnson | 224/601 |
| 5,205,803 | A * | 4/1993 | Zemitis | 482/121 |
| 5,448,805 | A * | 9/1995 | Allen et al. | 24/300 |
| 6,068,167 | A * | 5/2000 | Hopson | 224/150 |
| 6,325,258 | B1 * | 12/2001 | Verdugo et al. | 224/150 |
| 6,371,346 | B1 * | 4/2002 | Sharma | 224/578 |
| 6,971,334 | B1 * | 12/2005 | Livesay et al. | 119/798 |
| 7,103,943 | B2 * | 9/2006 | Lambert | 24/298 |
| 2006/0011677 | A1 * | 1/2006 | Burnsed et al. | 224/150 |
| 2006/0208016 | A1 * | 9/2006 | Esch | 224/150 |
| 2006/0273128 | A1 * | 12/2006 | Balakier | 224/578 |
| 2007/0039562 | A1 * | 2/2007 | Carter | 119/798 |
| 2008/0217371 | A1 * | 9/2008 | Wemmer | 224/579 |
| 2010/0206921 | A1 * | 8/2010 | Shen | 224/150 |

* cited by examiner

*Primary Examiner* — Justin M Larson
*Assistant Examiner* — Corey N Skurdal
(74) *Attorney, Agent, or Firm* — Thomas M. Freiburger

(57) ABSTRACT

A gun sling for carrying a rifle or shotgun is adjustable to serve either as a bungee sling or a fixed-length, non-stretch sling. In a preferred embodiment this is realized with a flexible sheath forming a portion of the sling, with a bungee cord or stretchable strap inside the sheath. With the bungee relaxed the sheath forms a non-stretchable but flexible portion of the sling. When the bungee cord is stretched and tensioned, the sheath gathers and shortens so that the bungee provides for a desired length of stretch.

10 Claims, 4 Drawing Sheets

ADJUSTABLE GUN SLING

BACKGROUND OF THE INVENTION

This invention concerns equipment for military or police, such as police tactical personnel (SWAT), and in particular encompasses a gun sling which is adjustable from use as a bungee sling to use as a fixed-length sling.

Gun slings for military and police rifles have been of several different types, depending on the needs and desires of the user. There are single point slings and dual point slings, the single point slings comprising a loop of strapping, with provision to connect with the rifle at one point, while the dual point slings comprise a non-loop length of strapping with connection points at both ends. Also, some users prefer a bungee sling, which provides for elastic stretching and thus a somewhat springy suspension of the rifle, while others desire a non-stretch, fixed-length sling, depending in part on the situation.

It is an objective of the current invention to provide gun slings that allow a user the option of bungee sling or a fixed-length sling, with either a single or double-point gun connection.

SUMMARY OF THE INVENTION

Pursuant to the current invention, a gun sling for carrying a rifle or shotgun is adjustable to serve as a bungee sling or a fixed-length, non-stretch sling. In a preferred embodiment this is realized with a flexible sheath forming a portion of the sling, with a bungee cord or stretchable strap inside the sheath. With the bungee relaxed the sheath forms a non-stretchable but flexible portion of the sling. When the bungee cord is stretched and tensioned, the sheath gathers and shortens so that the bungee provides for a desired length of stretch.

The gun sling preferably includes a length adjustment, in a non-adjustable portion of the strap. This can be a tri-glide type adjustment buckle, and a quick-adjustment, with a spring-loaded cam lock, can also or alternatively be included.

Elastic slide loops can be included on the non-adjustable portions of the strap to cover strap tails and buckles involved in the change from bungee to fixed-length and vice versa. These loops may be located at each point where a buckle or a strap tail occurs, and are used to cover the buckle and to neatly store the extended strap tail as needed.

In a preferred embodiment two web extensions are provided, one at each end of the elastic cord, so that the cord is stretched from both ends when the bungee function is desired.

More broadly the invention encompasses an adjustable gun sling, for either single-point or dual-point connection, which comprises a flexible strap that includes in its length an adjustable portion that can be selectively of fixed length or elastically stretchable, with provision for convenient user selection.

It is among the objects of the invention to provide military and police personnel with a single gun sling that allows the function of either a bungee sling or a fixed-length sling, with easy selection of either mode. These and other objects, advantages and features of the invention will be apparent from the following description of a preferred embodiment, considered along with the accompanying drawings.

DESCRIPTION OF PREFERRED EMBODIMENTS

Figure 1:
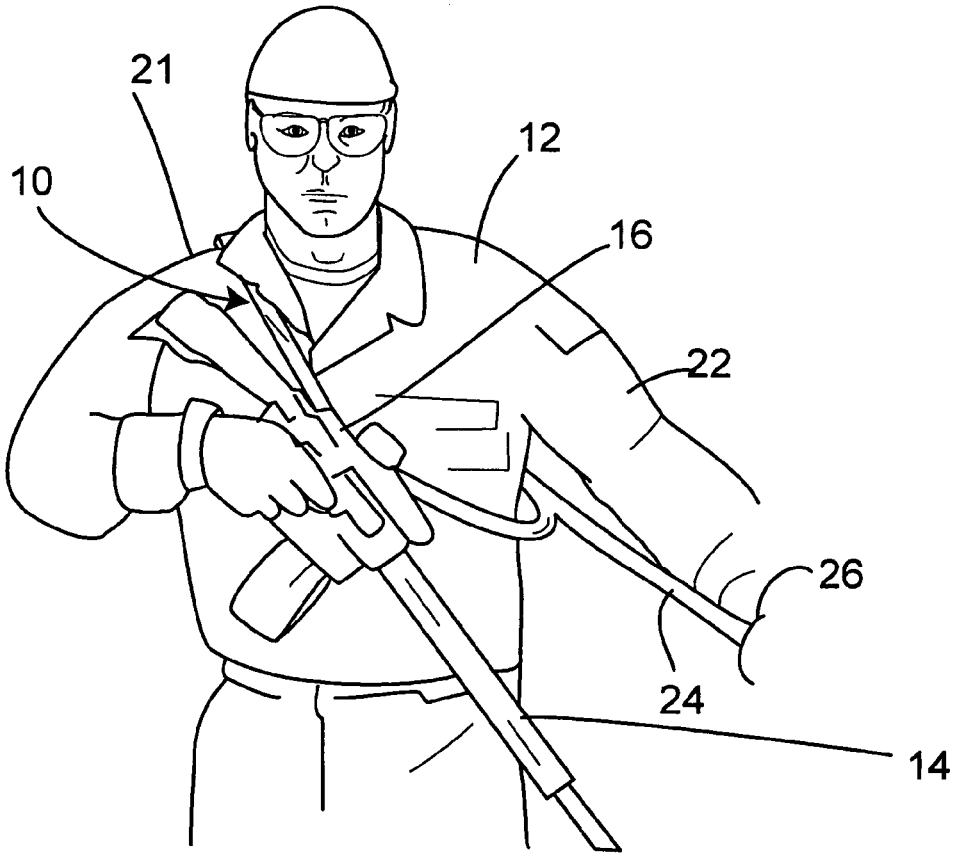
FIG. 1 is a schematic view indicating a person using a dual-point gun sling to suspend a rifle over the shoulder.
Figure 1A:
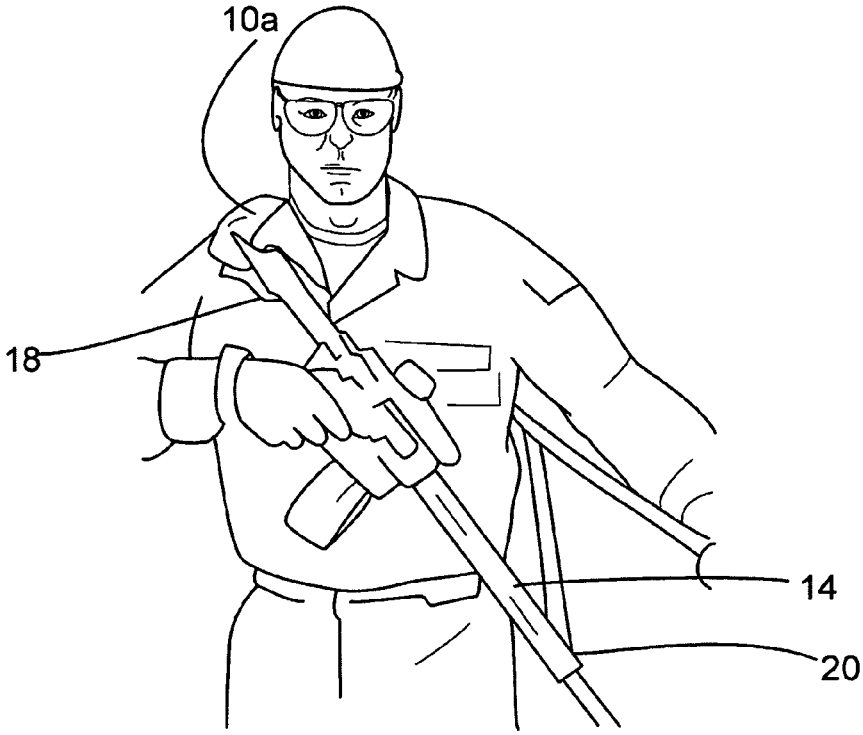

FIG. 1 shows a gun sling 10 as worn by a user 12 who may be military or police personnel. The gun sling 10 supports any of various forms of rifle 14, and in this case, a single-point connection, at the area shown at 16, supports the rifle on the gun sling. FIG. 1A, a similar drawing, shows a gun 14 supported on a dual-point sling 10*a*, with upper and lower connection points at 18 and 20.

As illustrated, the gun sling of the inventions rests on one shoulder 21 (FIG. 1), and extends around the body and below the opposite arm 22. The gun sling 10 comprises generally a strap formed in a loop configuration for the single-point sling of FIG. 1, and FIG. 1 shows a strap extension or web extension 24 being gripped and pulled by the user's left hand 26. This function will be explained below.

Figure 2:
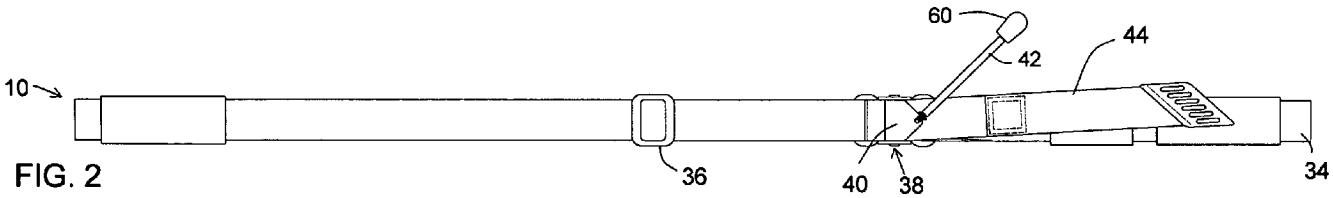
FIGS. 2, 3 and 4 are views showing the back side, elevation and front side of a single-point adjustable gun sling of the invention.
Figure 3:
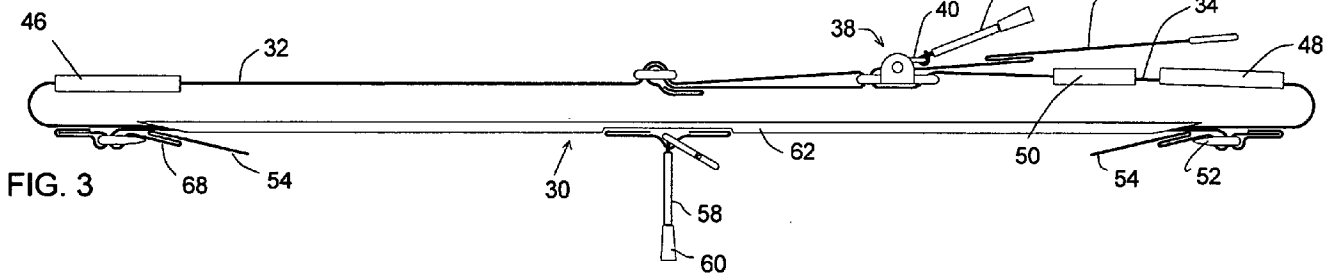
Figure 4:
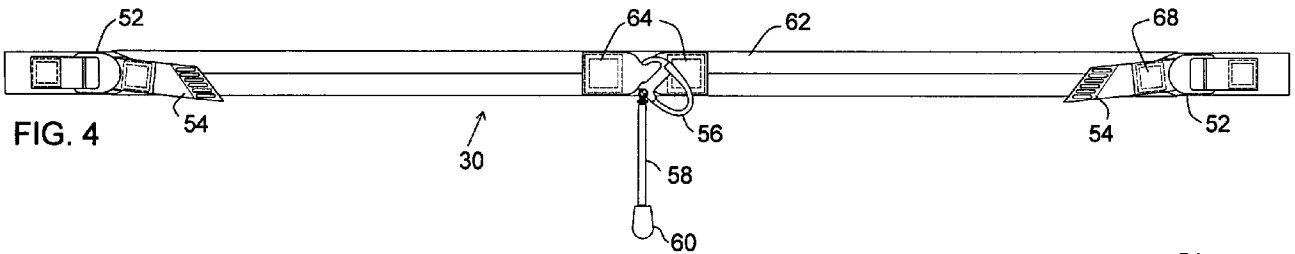

FIGS. 2 through 4 show a single-point connection gun sling 10 of the invention, generally as shown in FIG. 1. These views show the back side of the looped gun sling, the loop in plan view, showing the entire circumference, and the front side of the sling, respectively. These figures show that the gun sling 10 comprises essentially a flexible strap that extends substantially through the entire length of the gun sling. Within this strap 10 is an adjustable portion 30 as in FIGS. 3 and 4. The remaining strap portions 32 and 34 are non-stretching and not adjustable in the same sense as the portion 30. The remaining strap portions 32 and 34 preferably are formed of conventional webbing material as used on gun slings, which normally is a weave of artificial fibers, wide enough for comfort (preferably about one inch wide or wider). Length adjustments preferably are provided in these remaining strap sections. Thus, FIGS. 2 and 3 show a tri-glide 36 that may be included at the back of the gun sling, a conventional adjustment buckle-type device that is adjusted by feeding strap into the bubble and sliding, this being used commonly to adjust for the user's body size.

In addition, the drawings show a quick adjustment 38 with a spring-loaded pivoted cam 40. This quick adjustment device 38 is shown with a release pull 42 secured to the cam 40, such that upward (outward) pulling on the cam will release the cam's grip on the strap portion 34 so that length can be adjusted by pulling on a strap tail 44 or pulling in the opposite direction via the strap portion 34. The quick adjustment cam buckle device 38 can be configured so that the strap can be shortened (by pulling on the end or tail 44) even without manually releasing the cam, but release is necessary to let strap out and lengthen the strap. FIGS. 2 and 3 also show slidable looped elastic covers 46, 48 and 50 which extend around the strap 10 and are slidable into position to cover the buckle 40 and extending tail or end 44, folded and tucked (elastic loop cover 50), as well as adjustment devices at the front side of the sling as described below.

FIGS. 3 and 4 reveal that the front side of the sling or strap 10 has the adjustable section 30 that extends between two adjustment buckles 52. These adjustment buckles can be simple ladder-lock buckles of the well known type that allow pulling on a web extension 54 to pull a web strap through the ladder-lock buckle, where the strap will then be held with friction against tension in the section 30 which would tend to pull the web extension back through the ladder-locks in the opposite direction. Release can be made by tilting the ladder-lock buckles in the usual way ladder-locks are used.

FIG. 4 shows the front or forward side of the sling 10. FIG. 4 should be considered along with FIG. 3, as well as FIGS. 5 and 6. The adjustable portion 30 of the looped sling or strap 10 has a connection 56 for a rifle, and this may be the type of connection known as a snap shackle, such as used in the marine industry. A pull handle 58 allows quick release of the snap shackle to remove the rifle from the sling. The pull handle 58 is shown in a straight configuration in these drawings, as is the pull handle 42 in FIG. 2, but it is preferably a cord, such as a flexible cord of woven or twisted plastic fibers, that preferably is encased in a plastic tubing or other outer covering. Military and tactical police gear should be devoid of any components or extensions that can snag on other equipment, on trees or brush or other environmental obstacles. Each of these handles may terminate in a rubbery or plastic knob 60.

Figure 5:
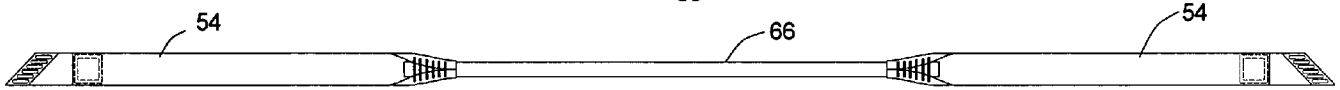
FIG. 5 is a view showing an internal elastic cord which forms a part of the adjustable gun sling, with web extensions at each end.

In this embodiment the adjustable section or portion 30 of the sling is formed of a sheath 62 which generally mimics the flat, wide shape of the remaining portions of the strap 32, 34. The connection point or snap shackle 56 of this single-point sling is secured by connected patches 64 of fabric, leather or other material, stitched or otherwise secured to the sheath 62. The web extensions or tails 54 are seen emerging from the sheath 62 at the positions shown at the ends of the adjustable section 30, passing through the retention buckles 52. These extensions 54, as shown in FIG. 5, are connected at their inner ends to a stretchable cord or bungee cord 66 that remains inside the sheath regardless of the mode of operation selected. The stretchable elastic cord 66 is relaxed in all of FIGS. 2, 3 and 4, as well as FIG. 5. In this relaxed condition of the elastic cord, the web extensions or tails 54 extend minimally out of the sheath, just enough to be grasped by the user. The web extensions 54 can have a Z-shaped or a zig zag reversible portion 68 wherein the web is tripled in thickness and stitched in that configuration for a short distance, each Z about one inch. This thicker patch in the web prevents the tail end or web extension 54 from slipping back into the sheath 62, through the buckles 52.

Figure 6:
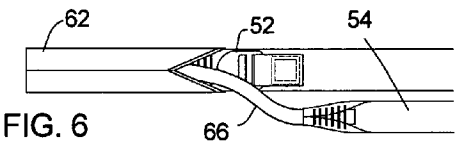
FIG. 6 is a detail view showing the internal elastic cord as it is assembled into the gun sling.

FIG. 6 is an assembly detail showing the bungee cord 66 extending out of the sheath 62, before being fully assembled into the sheath. The web extension 54, after the cord 66 has fully entered the sheath, will be threaded through the ladder-lock or other type buckle 52.

Figure 7:
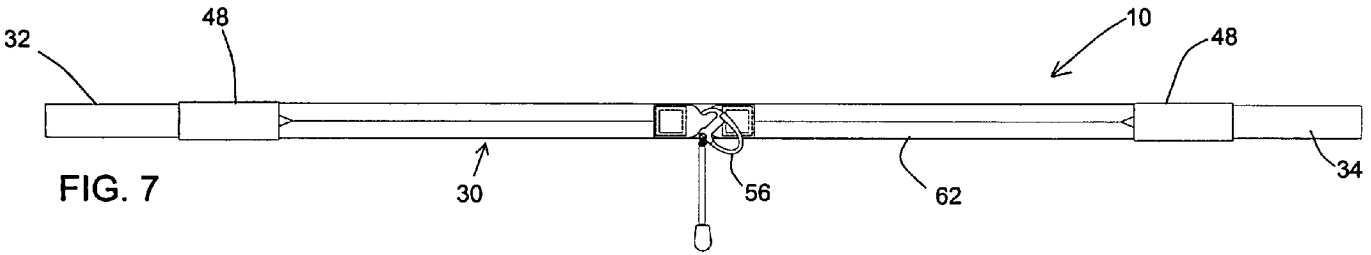
FIGS. 7, 8, 9 and 10 are a series of views showing a procedure for changing from one mode of operation to another, for an adjustable gun sling according to the invention.

FIGS. 7 through 10 demonstrate changing the mode of operation of the gun sling 10 from non-stretch, fixed-length configuration (which was shown in FIGS. 2, 3 and 4) to a bungee sling mode of operation. In FIG. 7 the elastic looped sheaths or covers 48 are shown covering the buckles 52 and the web extensions 54 of the sling, at either end of the adjustable portion 30. Compare FIG. 7 to FIG. 4. The sheath 62 of the adjustable portion is fully extended and serves as a non-extendable strap portion, in the same manner as the remaining strap portions 32 and 34. The connection point or snap shackle 56 is shown in the center.

Figure 8:
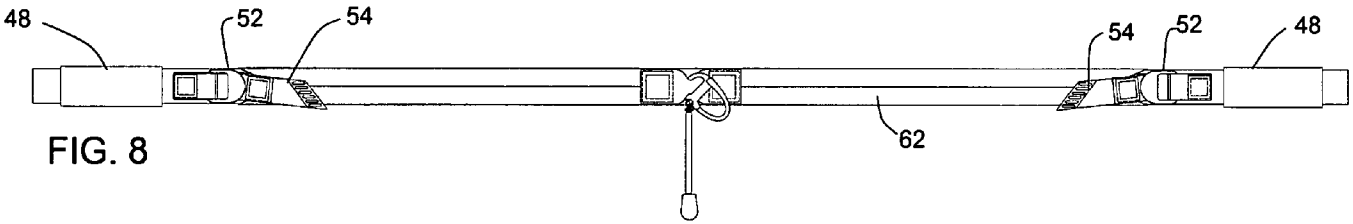
Figure 9:
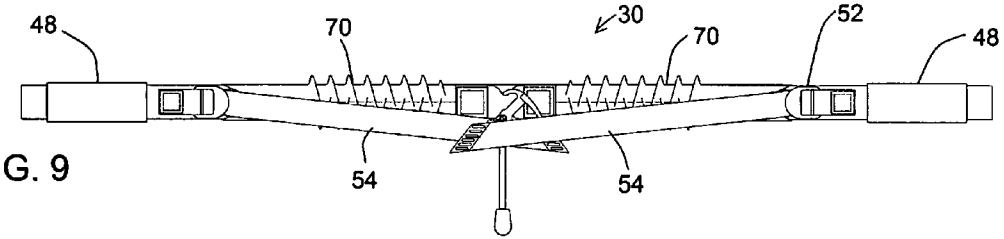

In FIG. 8 the elastic loop covers or sleeves 48 have been pulled back, outwardly from the adjustable portion 30. This exposes the web extensions 54, which are then pulled out from the sheath, toward one another, to the configuration shown in FIG. 9. The effect of the pulling out of these web extensions or tails 54 is to draw attention on the internal stretchable cord or bungee cord, that tension being effective to shorten the length of the adjustable section 30, gathering the sheath as shown at 70. The sheath may include some form of coil of wire or plastic material to encourage an orderly gathering of the sheath material. The internal bungee cord, while tensioned somewhat during the operation of pulling out the web extensions 54 and shortening the section 30, is essentially relaxed once this is accomplished and the sling is in the configuration shown in FIGS. 9 and 10. Once the sling is worn on a person, carrying all or part of the weight of a rifle, or if the web extensions are pulled out while the sling is worn, the bungee will be stretched and will remain in tension.

Figure 10:
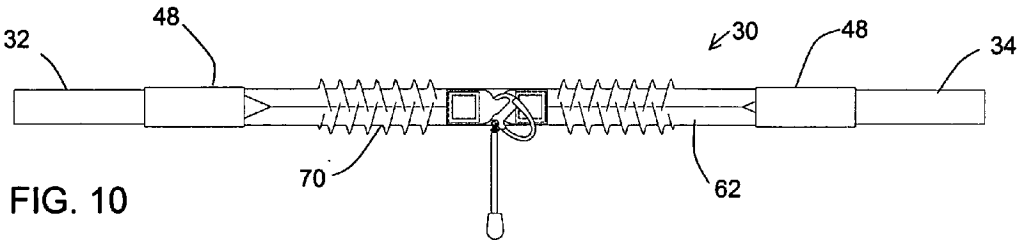

FIG. 10 shows this portion 30 of the single-point sling after the web extensions have been folded and stowed alongside the buckles 52 and the cover sleeves 48 have been positioned over these features.

In one embodiment of the invention, the web extensions 54 may be drawn out about 4 inches each, causing approximately 8 inches in reduction in the length of the adjustable section 30. This gives about 8 inches maximum stretch to the bungee sling in use. Less stretch can be provided if desired.

In a modification of the above, only one web extension and the buckle 52 can be provided, with the stretchable elastic cord 66 simply fixed inside the sheath at one end. Thus, for example, the left end of the bungee cord 66 seen in FIG. 5 can be without any web extension 54 but simply anchored to the remaining strap portion 52, along with the anchoring of that sheath 62 to that strap portion 42. In this way the single strap is simpler and one-handed in operation, and the single extension 54 can be somewhat longer than one of the extensions seen in the drawings or simply less stretch distance can be provided in the bungee sling mode of operation. Note that the "spring constant", i.e. to force required to stretch the bungee and the change in force as stretching increases, can be selected as desired and may be different for a single-extension sling.

FIGS. 1 and 2 show the user pulling a web extension, shown at 24 in those drawings, equivalent to one of the web extensions 54. This action converts a non-stretch sling to a bungee sling. Stowing of the pulled strap or tail can then be accomplished using two hands, if necessary, with an elastic slidable sleeve then placed over the stowed strapping buckle, as described above.

Note that the user may or may not want to adjust the length of the overall sling, whether a single-point sling or a dual-point sling, after changing to the bungee sling mode. If adjustment is needed to restore some of the length, this is done using the tri-glide 36 or the quick adjustment 38 (FIGS. 2 and 3).

It should also be understood that the invention can encompass other arrangements for switching from a fixed-length gun sling to a bungee sling. For example, an elastic cord or bungee cord could be permanently and non-adjustably positioned within a sheath such as the sheath 62 shown in the drawings. The bungee can be fixed at both ends to the remaining portions of the strap 32 and 34. A non-stretchable web or cord could be loosely contained within the sheath 62 alongside the bungee cord, with tail ends extending out, appearing similar to what is shown in FIG. 8, at least from the exterior (again, a single web extension or tail could be provided at one end if desired). In this case, pulling of the web extension or extensions, through a buckle or buckles, is effective not to shorten the adjustable section but to draw the non-stretchable cord taut alongside the relaxed bungee cord. With the buckle or buckles affixing the ends of the non-stretch cord to the other strap sections 32, 34, this pulling out of the internal strap or cord tail will effectively convert a bungee sling to a regular or non-stretch gun sling. Again, the web extension or extensions that are pulled out can be stowed under a slidable elastic loop or sheath.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A gun sling for engaging over a shoulder of a user and having a connection for securing to a rifle or other long gun, comprising:

a flexible strap extending substantially through an entire length of the gun sling, the strap including at least one gun connection point for securement of the gun sling to a rifle to suspend the rifle on the person of a user, the flexible strap including in its length an adjustable portion which can be selectively of fixed length or elastically stretchable, the adjustable portion including a flexible, non-stretchable sheath secured at opposite ends to remaining strap sections, and an elastically stretchable cord contained within the sheath and having a hand-grippable web extension secured to the stretchable cord at least on one end of the cord, the web extension passing through a buckle attached to a remaining section of the strap and exposed at the exterior of the gun sling for pulling by the user, whereby the gun sling has use as a fixed-length non-stretch sling or as a bungee sling, easily controlled by a user by pulling the web extension to stretch the elastic cord into a tensioned condition, thereby shortening and gathering the sheath surrounding the stretchable cord, when desired, or the web extension can be released using the buckle, to be pulled back into the sheath by the stretchable cord to relax the stretchable cord when the user desires a non-stretch gun sling.

2. A gun sling as in claim 1, including a sling length adjustment in a remaining section of the strap.

3. A gun sling as in claim 1, wherein the sling is a single-point sling and the flexible strap being in the form of a loop.

4. A gun sling as in claim 1, wherein the sling is a dual-point sling with two ends each having a gun connection point.

5. A gun sling as in claim 1, wherein the web extension comprises a flat extension strap fixed to the elastic stretchable cord.

6. A gun sling as in claim 1, wherein the connection point comprises a snap shackle.

7. A gun sling as in claim 1, including a tri-glide length adjustment in a remaining portion of the strap.

8. A gun sling as in claim 1, further including an elastic retainer band loop slidably and closely fitted on the strap, to slide over and cover the buckle and the web extension.

9. A gun sling as in claim 1, wherein said web extensions are included on each of two ends of the stretchable cord and including two said buckles.

10. A gun sling as in claim 1, wherein the adjustable portion when the elastic cord is tensioned permits stretching of about 8 inches.

* * * * *